US005644340A

United States Patent [19]

Harney

[11] Patent Number: 5,644,340

[45] Date of Patent: Jul. 1, 1997

[54] FREQUENCY MIXING FOR CONTROLLING INDIVIDUAL PIXELS IN A DISPLAY

[76] Inventor: Michael Harney, 5263 S. Cobble Creek Rd. #24I, Salt Lake City, Utah 84117

[21] Appl. No.: 405,361

[22] Filed: Mar. 16, 1995

[51] Int. Cl.[6] ..... G09G 5/00

[52] U.S. Cl. ..... 345/212; 345/147

[58] Field of Search ..... 345/212, 55, 68, 345/100, 95, 205, 208, 214, 90, 91, 147; 359/58, 59

[56] References Cited

U.S. PATENT DOCUMENTS

| | | | |
|---|---|---|---|
| 4,426,643 | 1/1984 | Martin | 345/214 |
| 4,586,039 | 4/1986 | Nonomura et al. | 345/90 |
| 4,621,260 | 11/1986 | Suzuki et al. | 345/208 |
| 4,758,831 | 7/1988 | Kasahara et al. | 345/208 |
| 4,870,396 | 9/1989 | Shields | 345/90 |
| 5,008,657 | 4/1991 | Hanson et al. | 345/208 |
| 5,032,830 | 7/1991 | Kuijk | 345/208 |
| 5,191,322 | 3/1993 | Katayama et al. | 359/58 |
| 5,339,090 | 8/1994 | Crossland et al. | 345/90 |
| 5,471,225 | 11/1995 | Parks | 345/90 |
| 5,500,748 | 3/1996 | Gaalema et al. | 359/59 |

*Primary Examiner*—Kee M. Tung

*Assistant Examiner*—Martin Loui

*Attorney, Agent, or Firm*—Terry M. Crellin

[57] ABSTRACT

Individual pixels in a display formed of a plurality of pixels are controlled using a plurality of mixers, with each mixer having first and second inputs and an output. The mixers are connected to correspond to a matrix of rows and columns. The first inputs of all mixers corresponding to a particular, individual row in the matrix are connected to a common row lead, there being an equal number of row leads to the number of rows in the matrix. The second inputs of all mixers corresponding to a particular, individual column in the matrix are connected to a common column lead, there being an equal number of column leads to the number of columns in the matrix. A distinctive alternating signal is fed to each of the row leads, wherein the signal fed to one row lead differs from any signal fed to any other row lead by a predetermined, set frequency. An alternating signal is selectively fed to one or more of the column leads, wherein the signal fed to any particular column lead at any one time has the same frequency of one of the signals fed to the row leads. The mixer corresponding to the row which has the same frequency as the frequency being selectively fed to the column lead produces a DC voltage as an output signal from the output of the mixer. That DC voltage output is used to drive individual pixels on the display.

8 Claims, 2 Drawing Sheets

FREQUENCY MIXING FOR CONTROLLING INDIVIDUAL PIXELS IN A DISPLAY

BACKGROUND OF THE INVENTION

1. Field of the Invention

The present invention relates to a method of controlling individual pixels in a display formed of a plurality of pixels wherein a frequency mixing system is employed to control individual pixels in the display.

2. State of the Art

Digital systems have been used to control displays formed from a plurality of pixels. Such displays range from relatively small screens as used on digital equipment such as lap top and notebook computers to large displays used in outdoor signs. In conventional digital control systems, gray scale is implemented by adjusting the logical "ON" time for each pixel according to brightness (brighter pixels are simply turned on longer than pixels that are not as bright). This division of time for controlling brightness results in a high digital bandwidth for the computer controlling the display.

In addition, digital systems must use a complex system of timing for turning pixels on and off inasmuch as two pixels occurring in a different row or column cannot be turned on simultaneously without inadvertently turning on two additional pixels that are not intended to be turned on. FIG. 1 of the drawings shows what happens when a digital system attempts to turn two pixels on at the same time when the two pixels are in a different column or row. In the array shown in FIG. 1, say it is desired to turn on pixels 3 and 8. If a digital system is being used to control the display, a pixel will be on when the column in which it resides is high and the row in which it resides is low. Thus, to turn on pixel 3, column 1 must be high and row 3 must be low. Now, if it is attempted to simultaneously turn pixel 8 on, column 3 must be made high and row 2 must be made low. Unfortunately, as can be seen, when this is done, pixels 2 and 9 are turned on in addition to the intended pixels 3 and 8. Pixels in different rows and columns thus need to be controlled individually, i.e., be turned on and off separately.

To turn each pixel on separately from other pixels while adjusting gray scale and running 10 to 30 frames per second on the display requires a broad bandwidth on the computer which is being used to control the display. For a display having 3000 pixels, with a gray scale of 256 and the capacity to run 30 frames per second on the display, the computer required must have the capability of running at a clock speed of over 100 MHz. It would be highly desirable to provide a method of controlling individual pixels in a display that can utilize a much less powerful computer running at a clock speed of less than 10 to 20 MHz.

OBJECTIVES AND BRIEF DESCRIPTION OF THE INVENTION

A principal objective of the invention is to provide a novel method of controlling individual pixels in a display formed of a plurality of pixels.

A particular objective of the present invention is to provide such a method which utilizes frequency mixing to control the individual pixels of the display.

Another objective of the present invention is to provide such a method that can be used with a computer running at a clock speed of less than 10 to 20 MHz and is capable of controlling the individual pixels of a display having on the order of 3000 pixels, while operating the display at 30 frames per second with a gray scale of 256.

The above objectives are achieved in accordance with the present invention by providing a novel method of controlling individual pixels in a display formed of a plurality of pixels. The method comprises providing a plurality of mixers, with each mixer having first and second inputs and an output. The mixers are interconnected to correspond to a matrix of rows and columns, wherein the first inputs of all mixers corresponding to a particular individual row in the matrix are connected to a common row lead, there being an equal number of row leads to the number of rows in the matrix. Further, the second inputs of all mixers corresponding to a particular, individual column in the matrix are connected to a common column lead, there being an equal number of column leads to the number of columns in the matrix.

A distinctive alternating signal is fed to each of the row leads, wherein the signal feed to one row lead differs from any signal feed to any other row lead by a predetermined, set frequency. An alternating signal is selectively fed to one or more of the column leads, wherein the signal fed to any particular column at any one time has the same frequency of one of the signals fed to the row leads. The mixer corresponding to the row which has the same frequency as the frequency being selectively fed to the column lead produces a DC voltage as an output signal from the output of the mixer.

The output signals from the individual mixers are fed to separate and distinct individual low pass filters. The output of each low pass filter is then used to control an individual pixel in the display.

Additional objects and features of the invention will become apparent from the following detailed description, taken together with the accompanying drawings.

THE DRAWINGS

A preferred embodiment of the present invention representing the best mode presently contemplated of carrying out the invention will be described with reference to the accompanying drawings in which.

DETAILED DESCRIPTION OF THE ILLUSTRATED EMBODIMENTS

Figure 2:
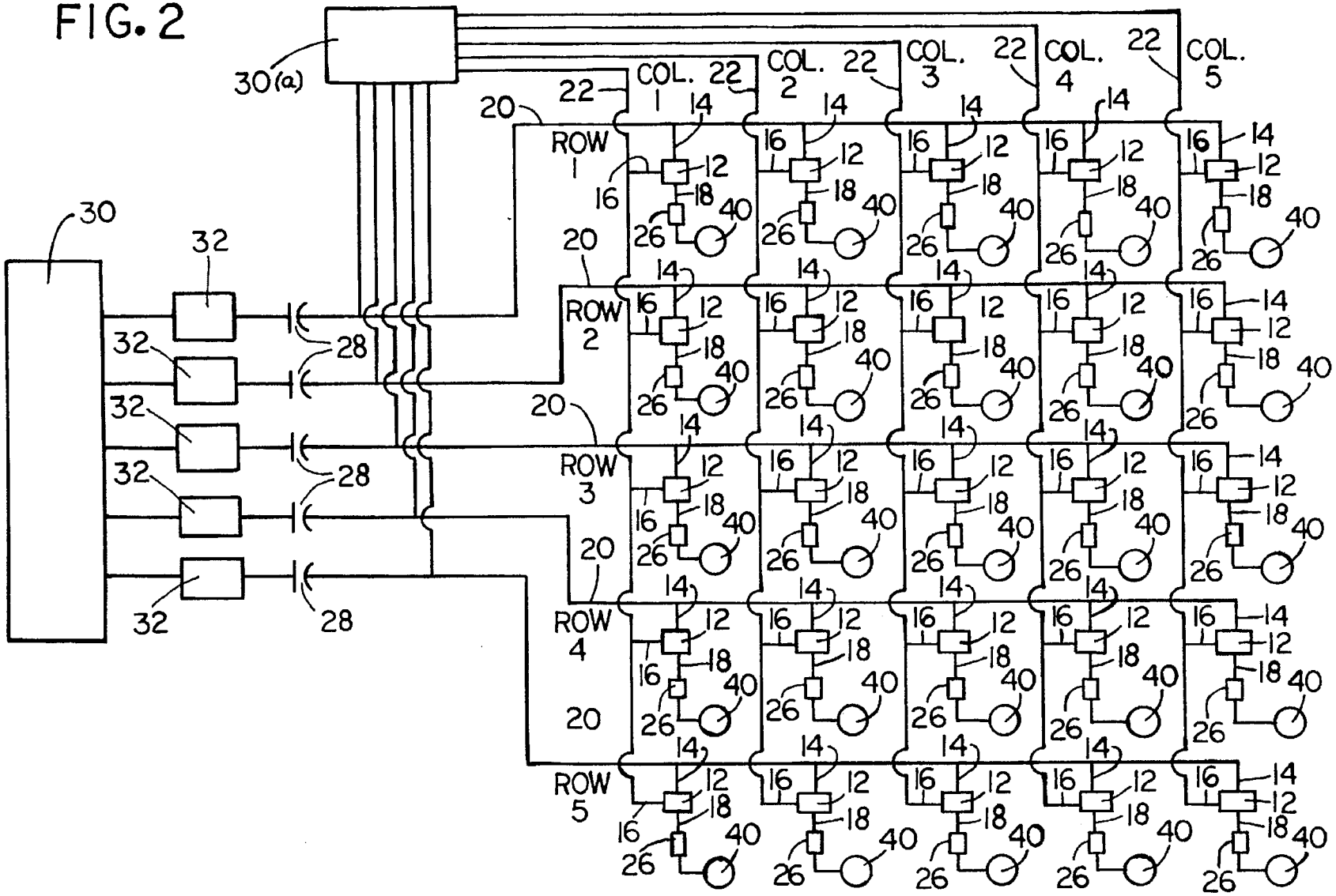
FIG. 2 is a schematic representation of a display that is controlled by an improved method in accordance with the present invention.

The novel method in accordance with the present invention for controlling individual pixels in a display formed of a plurality of pixels will be described with reference to FIGS. 2 and 3 of the drawings. A plurality of mixers 12 are provided, with each mixer 12 having a first input 14, a second input 16 and an output 18. The mixers 12 are interconnected so as to correspond to a matrix of rows and columns. As shown in FIG. 2, there are 25 mixers 12 arranged in 5 rows and 5 columns. The first inputs 14 of all mixers 12 corresponding to a particular, individual row in the matrix are connected to a common row lead 20. There are an equal number of row leads 20 to the number of rows in the matrix. Thus, as illustrated in FIG. 2, there are 5 row leads 20. The second inputs 16 of all mixers 12 corresponding to a particular, individual column in the matrix are connected to a common column lead 22. There are an equal number of column leads 22 to the number of columns in the matrix. Thus, as illustrated in FIG. 2, there are 5 column leads 22.

In accordance with the method of the present invention, a distinctive alternating signal is fed to each of the row leads 20, wherein the signal fed to one row lead 20 differs from any signal fed to any other row lead 20 by a predetermined, set frequency. A frequency difference equal to the cut-off frequency of a common low pass filter is sufficient between any two row leads. An alternating signal is selectively fed to one or more of the column leads 22. The alternating signals are controlled signals that will be used to control a pixel 40 that is associated with each mixer 12. The alternating signal fed to any particular column lead 22 at any one time has the same frequency of one of the signals fed to the row leads 20, whereby the mixer corresponding to the row which has the same frequency as the frequency being selectively fed to the column lead 22 produces a DC voltage as an output signal from the output of the mixer 12.

The mixers 12 act as discriminators. They in essence recognize when a particular control signal is of the same frequency as the row signal. When this occurs, the output of the mixer is a DC voltage equivalent to the amplitude of the control signal multiplied by the amplitude of the row signal. The amplitude of the row signal is advantageously maintained at 1 so that the output of the mixer is a DC voltage equivalent to the amplitude of the control signal.

If the amplitude of the row signals fed to rows 1 through 5 is 1 and the frequencies are 4 KHz, 6 KHz, 8 KHz, 10 KHz and 12 KHz, the mixer 12 in column 3, row 2 can be activated by feeding a control signal to the column lead 22 for column 3 that includes an alternating signal having a frequency of 6 KHz. The mixer 12 would recognize the match in the frequencies in its inputs 14 and 16, and the output 18 of the mixer 12 would be a DC voltage corresponding to the amplitude of the control signal fed to the column lead 22 for column 3. The brightness of the pixel that is associated with the mixer in column 3, row 2 could be varied by varying the amplitude of the control signal fed to the column lead 22 for column 3.

More than one mixer 12 in column 3 can be activated at a time by simply feeding a combination of alternating control signals to the respective column lead 22 for column 3. For example, if one desires to activate the mixer 12 in column 3, row 4 in addition to the mixer 12 in column 3, row 2, two control signals (one of a frequency of 6 KHz and the other of a frequency of 10 KHz) would be fed to the column lead 22 for column 3. The mixers 12 at rows 2 and 4 of column 3 would recognize their respective frequencies and would be activated.

It is preferable to provide a plurality of low pass filters 26, with a respective low pass filter 26 being connected to the output 18 of each of the mixers 12. The output signals from each of the mixers 12 are fed to respective low pass filter 26, and the low pass filters 26 block transient alternating signals so that the output signals from the low pass filters 26 are clean DC signals. The output of each low pass filter 26 is used to control an individual pixel 40 on the display.

Figure 1:
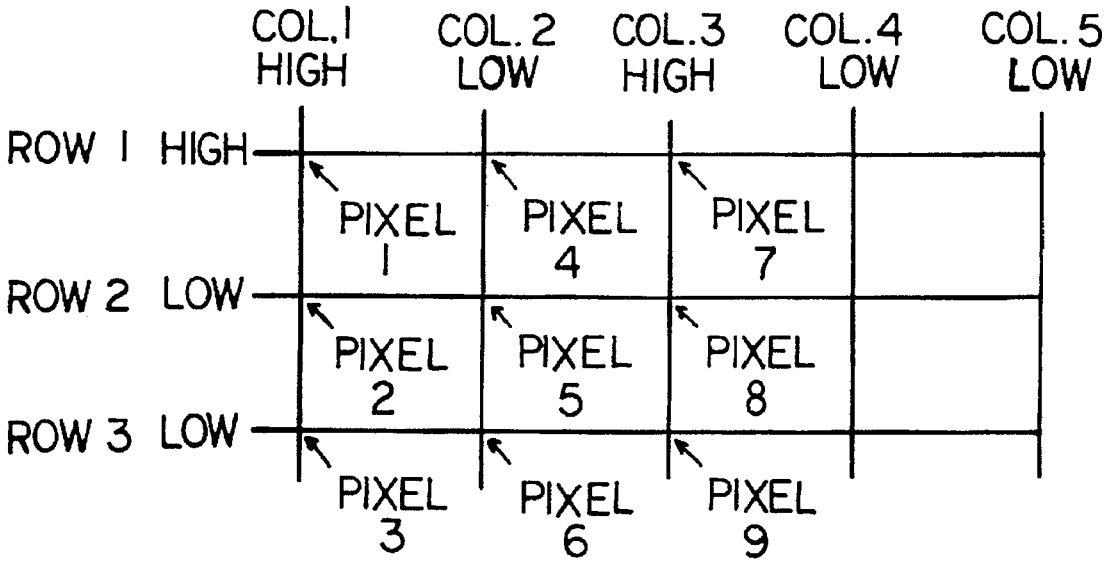
FIG. 1 (PRIOR ART)
FIG. 1 is a schematic representation of a display that is controlled by a digital system of the prior art.
Figure 3:
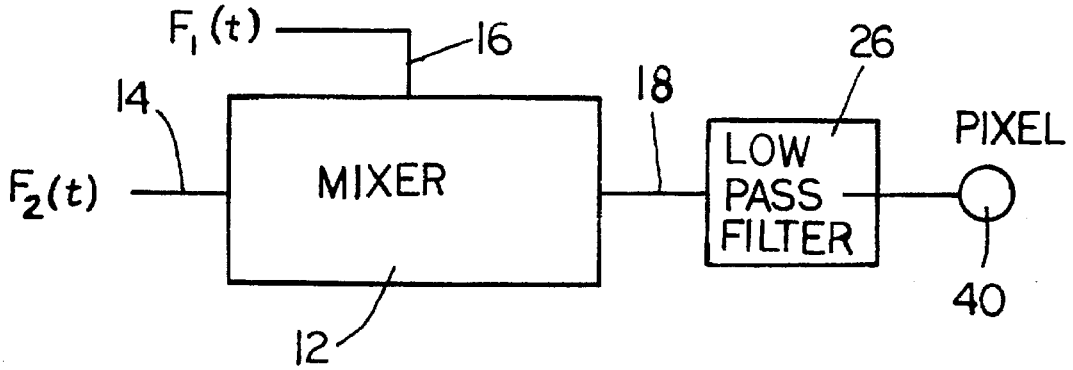
FIG. 3 is a schematic representation of a mixer as used in the method of the present invention.

FIG. 3 shows the mixer 12 and will be used to describe its operation. Two signals, $F_1(t)$ and $F_2(t)$, come into the mixer at frequencies $f_1$ and $f_2$. The mixer is just a high-bandwidth multiplier circuit that produces an output that is equivalent to the two signals $F_1(t)$ and $F_2(t)$ multiplied together. If $F_1(t)$ is a sine wave at a pure frequency, say $A_1\sin(2\pi f_1 t)$, and $F_2(t)$ is another pure sine wave, say $A_2\sin(2\pi f_2 t)$, then the output $F_1(t)F_2(t)$ is equal to $A_1A_2\sin(2\pi f_1 t)\sin(2\pi f_2 t)$, wherein A is an amplitude of a respective sine wave and t is the time variable. Using the trigonometric identity, $\sin(2\pi f_1 t)\sin(2\pi f_2 t)$ equals $\frac{1}{2}\cos(2\pi t(f_1-f_2))-\frac{1}{2}(\cos(2\pi t\ (f_1+f_2))$, the product $F_1(t)F_2(t)$ now becomes $$F_1(t)F_2(t)=A_1A_2(\cos(2\pi t(f_1-f_2))-(\cos(2\pi t(f_1+f_2)))/2 \quad \text{(Equ. 1)}$$

This equation can be simplified. If $f_1=f_2$, then $$F_1(t)F_2(t)=A_1A_2(1-\cos(4\pi f_1 t))/2 \quad \text{(Equ. 2)}$$

The simplified expression for $F_1(t)F_2(t)$ corresponds to a DC term $(A_1A_2/2)$ and an AC term $A_1A_2/2(\cos(4\pi f_1 t))$, with the AC term at twice the frequency of $f_1$. FIG. 3 shows two sine waves being fed to the inputs of the mixer 12 with a low pass filter 26 on the output of the mixer 12. If the low pass filter 26 has a cut-off frequency of 2 KHz or less, and the sine waves $F_1(t)$ and $F_2(t)$ going into the mixer 12 have respective frequencies $f_1$ and $f_2$ of 4 KHz and 2 KHz, then the output of the mixer 12 will be (from Equ. 1), a sine wave $F_1(t)-F_2(t)$ having a frequency of 2 KHz and another sine wave $F_1(t)+F_2(t)$ having a frequency of 6 KHz. Both frequencies will be eliminated by the 2 KHz low pass filter 26 to at least 20 dB (1/10) for a simple RC filter. If the frequencies are equal then the DC term from Equ. 2, $(A_1A_2/2)$, is passed through the filter and on to the pixel as the product of the two sine wave amplitudes, and the AC term, $A_1A_2/2(\cos(4\pi f_1 t))$, is eliminated. By making the two frequencies equal, one can control the brightness of the lamp by controlling the amplitude of one of the two sine waves. If the frequencies are not equal, and vary from each other by at least 2 KHz, then the pixel is not turned on.

If one of the frequencies is called the ROW frequency, and the other frequency is the COLUMN frequency, then a number of pixels in the same row but in different columns can be selected by keeping the COLUMN frequency constant and changing the ROW frequency. The ROW frequency is now defined as the sum of each of the COLUMN frequencies at a different amplitude:

ROW 1 frequency=($A_1$COLUMN 1 frequency)+($A_2$COLUMN 2 frequency)+($A_3$COLUMN 3 frequency)+etc.

If the COLUMN 1 frequency (with an amplitude of 1) is multiplied by the ROW frequency:

COLUMN 1 ($A_1$COLUMN 1 frequency+$A_2$COLUMN 2 frequency, etc.)

then the pixel 40 at column 1 and row 1 will be controlled by amplitude $A^1$ because that will be the only resulting DC term. The COLUMN 2 and COLUMN 3 frequencies will not be the same as the COLUMN 1 frequency (being different by 2 KHz from column to column) and their amplitudes will be eliminated by the low pass filter 26. Changing $A_2$ and $A_3$ will not change the pixel 40 at row 1 and column 1, but it will change the pixels 40 at row 1 and columns 2 and 3, respectively. If ROW 2 frequency is the sum of the column frequencies again at different amplitudes:

ROW 2=$A_4$COLUMN 1 frequency+$A_5$COLUMN 2 frequency, etc . . . then $A_4$ will control the pixel 40 at column 1 and row 2, and $A_5$ will control the pixel 40 at column 2 and row 2, because the amplitude of COLUMN 1 frequency is $A_4$ and COLUMN 2 is $A_5$ and these are the only DC terms that will result from the multiplication of the column and row frequencies.

The end result is that each pixel 40 has an individual amplitude (or brightness) control—$A_1$, $A_2$, $A_3$, $A_4$, $A_5$ etc. By examining the row equations, it is obvious that each amplitude can be changed simultaneously because they are independent of each other. Also, because the rows are just the sums of the columns at different amplitudes, and the maximum frequency in the system is determined by the frequency separation between columns and the number of columns, the speed of the system driving the display is not affected by the number of rows—just the number of columns. This is remarkably different than the digital system, which goes up in speed proportionally to the number of rows X the number of columns. If the row and the column frequencies are synthesized with Digital to Analog Converters, and the data to these DAC's is controlled by a PC, then these amplitudes and frequencies are controlled digitally. The method of the present invention has been tested with an amplitude range (gray scale) of 4000, and because all pixels can be changed simultaneously without an increase in processing speed, the maximum frame rate is equal to the slowest pixel rate, which can be as low as 2 KHz. An inexpensive computer running under 4 MHz could easily satisfy this requirement.

In a preferred embodiment of the invention as shown in FIG. 2, a computer 30 is used to produce digital, square wave, alternating signals which are fed to digital to analog converters 32 and then to respective capacitors 28 to produce alternating sine wave signals. The alternating sine wave signals from the respective capacitors 28 are the signals that are selectively fed to one or more of the column leads 22. The signals are processed by a controller 30(*a*) of the computer 30 and selectively fed to one or more of the column leads 22. The controller 30(*a*) is part of the computer 30 and, of course, operated directly by the computer 30. The distinctive alternating signals fed to each of the row leads 20 are sine wave, alternating signals that can be produced in a similar manner. As shown in FIG. 2, the signals from the capacitors 28 are also fed to respective row leads 20 . The computer 30 can also be programmed to control the amplitudes of the alternating sine waves from the digital to analog converters 32, and the amplitudes of the alternating sine waves are used to control the brightness of the respective pixels 40 when the pixel is turned on.

The computer 30 can be used without a digital to analog converter. In such a situation, the computer produces digital, square wave, alternating signals. The digital, square wave, alternating signals are fed to respective capacitors 28 which produce alternating output signals, and the alternating output signals from the respective capacitors 28 are the signals that are selectively fed to one or more of the column leads 22 without being fed through the digital to analog converter of FIG. 2. One drawback of using a computer to produce square wave, alternating signals produced without further processing of the square wave signals by a digital to analog converter is that the amplitude of the square wave cannot be conveniently varied and, thus, the amplitude cannot be used to control the brightness of the pixel 40. Other methods of controlling brightness, such as the relative length of time that the pixel 40 is on, must be used.

Although preferred embodiments of the method of controlling individual pixels in a display formed of a plurality of pixels have been illustrated and described, it is to be understood that the present disclosure is made by way of example and that various other embodiments are possible without departing from the subject matter coming within the scope of the following claims, which subject matter is regarded as the invention.

I claim:

1. A method of controlling individual pixels in a display formed of a plurality of pixels, said method comprising providing a plurality of mixers, with each mixer having first and second inputs and an output;

connecting the mixers to correspond to a matrix of rows and columns, wherein the first inputs of all mixers, corresponding to a particular individual row in the matrix, are connected to a common row lead, there being an equal number of row leads to the number of rows in the matrix, and further wherein the second inputs of all mixers, corresponding to a particular individual column in the matrix, are connected to a common column lead, there being an equal number of column leads to the number of columns in said matrix;

feeding a distinctive alternating signal to each of the row leads, wherein the signal fed to one row lead differs from any signal fed to any other row lead by a predetermined, set frequency;

selectively feeding an alternating signal to one or more of the column leads, wherein the signal fed to any particular column lead at any one time has the same frequency of one of the signals fed to the row leads, whereby the mixer corresponding to the row which has the same frequency as the frequency being selectively fed to the column lead produces a DC voltage as an output signal from the output of the mixer;

providing a plurality of low pass filters, with a respective low pass filter being connected to the output of each of the mixers;

feeding the output signals from each of the mixers to a respective low pass filter; and using the output of each low pass filter to control an individual pixel on said display.

2. The method in accordance with claim 1 wherein a computer is used to produce digital, square wave, alternating signals;

the digital, square wave, alternating signals are fed to respective capacitors which produce alternating output signals;

the alternating output signals from the respective capacitors are selectively fed to one or more of the column leads, whereby the computer can be programmed so as to control the individual pixels on said display.

3. A method in accordance with claim 1 wherein a computer is used to produce digital, square wave, alternating signals;

the digital, square wave, alternating signals are fed to respective digital to analog converters to produce alternating sine wave signals;

the alternating sine wave signals from the respective digital to analog converters are selectively fed to one or more of the column leads; and the distinctive alternating signal fed to each of the row leads is a sine wave, alternating signal, whereby the computer can be programmed so as to control the individual pixels on said display.

4. The method in accordance with claim 3 wherein the computer is also programmed to control the amplitudes of the alternating sine waves from the digital to analog converters, and the amplitudes of the alternating sine waves are used to control the brightness of respective pixels when turned on.

5. Apparatus for controlling individual pixels in a display formed of a plurality of pixels, said apparatus comprising a plurality of mixers, with each mixer having first and second inputs and an output;

means for connecting the mixers to correspond to a matrix of rows and columns, wherein the first inputs of all mixers corresponding to a particular individual row in the matrix are connected to a common row lead, there being an equal number of row leads to the number of rows in the matrix, and further wherein the second inputs of all mixers, corresponding to a particular individual column in the matrix, are connected to a common column lead, there being an equal number of column leads to the number of columns in said matrix;

means for feeding a distinctive alternating signal to each of the row leads, wherein the signal fed to one row lead differs from any signal fed to any other row lead by a predetermined, set frequency;

means for selectively feeding an alternating signal to one or more of the column leads, wherein the signal fed to any particular column at any one time has the same frequency of one of the signals fed to the row leads, whereby the mixer corresponding to the row which has the same frequency as the frequency being selectively fed to the column lead produces a DC voltage as an output signal from the output of the mixer;

a plurality of low pass filters, with a respective low pass filter being connected to the output of each of the mixers;

means for feeding the output signals from each of the mixers to a respective low pass filter; and means for using the output of each low pass filter to control an individual pixel on said display.

6. Apparatus in accordance with claim 5 further including a computer for producing digital, square wave, alternating signals;

a plurality of capacitors;

means for feeding the digital, square wave, alternating signals to respective capacitors to produce alternating output signals from the capacitors;

means for selectively feeding the alternating output signals from the respective capacitors to one or more of the column leads, whereby the computer can be programmed so as to control the individual pixels on said display.

7. Apparatus in accordance with claim 5 further including a computer for producing digital, square wave, alternating signals;

a plurality of digital to analog converters;

means for feeding the digital, square wave, alternating signals to respective digital to analog converters to produce alternating sine wave signals;

means for selectively feeding the alternating sine wave signals from the respective digital to analog converters to one or more of the column leads; and means for feeding said sine wave alternating signals to each of the row leads as the distinctive alternating signal, whereby the computer can be programmed so as to control the individual pixels on said display.

8. Apparatus in accordance with claim 7 wherein the computer is also programmed to control the amplitudes of the alternating sine waves from the digital to analog converters, and the amplitudes of the alternating sine waves are used to control the brightness of respective pixels when turned on.

* * * * *